United States Patent [19]

Hefler

[11] 4,438,927

[45] Mar. 27, 1984

[54] BASEBALL GAME

[76] Inventor: Rudolph R. Hefler, 17 E. Main St., Moorestown, N.J. 08057

[21] Appl. No.: 431,583

[22] Filed: Sep. 30, 1982

[51] Int. Cl.[3] ..... A63B 69/00

[52] U.S. Cl. ..... 273/90; 273/26 D

[58] Field of Search ..... 273/26 R, 26 D, 26 E, 273/29 A, 89, 90, 85 C, 85 D; 124/4, 5, 7

[56] References Cited

U.S. PATENT DOCUMENTS

| | | | |
|---|---|---|---|
| 266,980 | 11/1882 | Easton | 124/7 |
| 1,011,644 | 12/1911 | Pons | 273/89 |
| 1,074,880 | 10/1913 | Lynch | 273/185 D |
| 1,127,588 | 2/1915 | Carlson | 273/26 E |

*Primary Examiner*—George J. Marlo

*Attorney, Agent, or Firm*—Duffield & Lehrer

[57] ABSTRACT

A baseball game includes a horizontal platform with a simulated baseball field on the top surface thereof. A baseball is carried at the top end of a rod, the bottom end of which is spring mounted to the board adjacent home plate. The ball and rod are held downwardly against the spring force and in line with the pitcher's mound by an electromagnet and are pitched when a pitcher releases a switch for the electromagnet. The pitcher may also control whether the pitch will be directly across the plate, inside or outside. The batter hits the pitched ball forcing the ball and rod downwardly and the angular position at which it hits the platform will be sensed by one of a plurality of switches. A visual indicator connected to the switches will indicate the position at which the ball struck. The various positions will be assigned various results such as "out," "base hit," "home run," etc. which will also be indicated.

5 Claims, 7 Drawing Figures

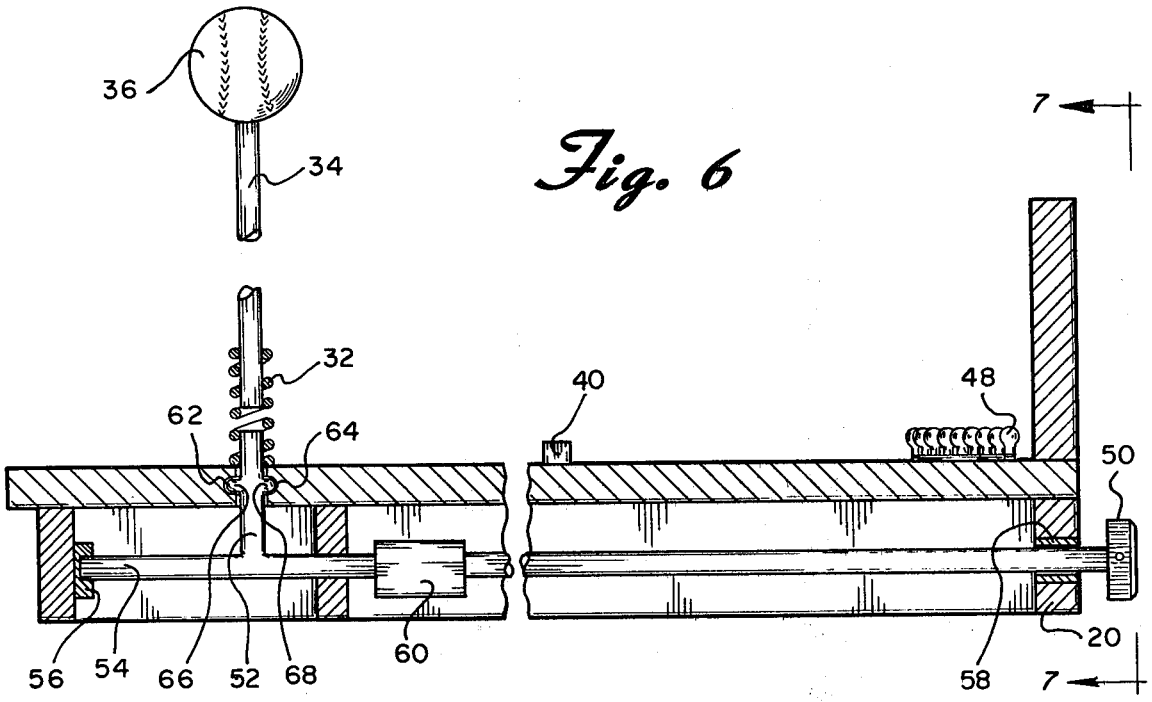
Fig. 6
Fig. 7
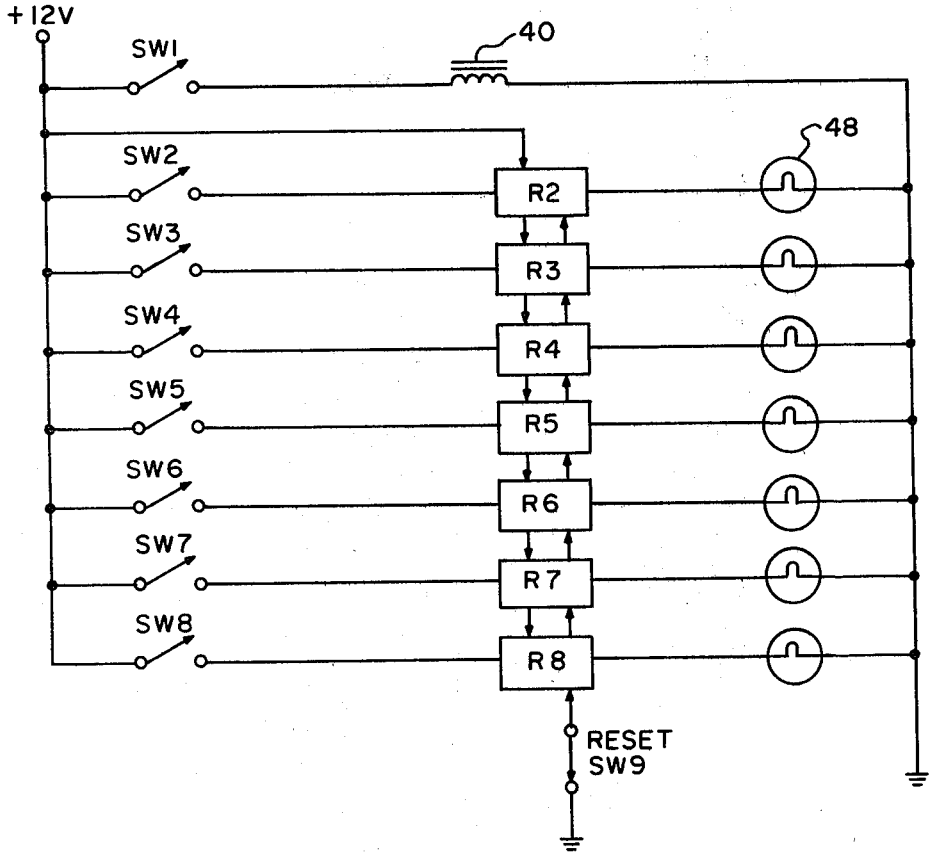

BASEBALL GAME

BACKGROUND OF THE INVENTION

The present invention is directed toward a baseball game and more particularly toward such a game which may utilize a regulation size baseball and bat but which may be utilized indoors.

Baseball has been referred to as the "National Pastime." It certainly is one of the most popular sports in this country. Participation in the sport is, however, limited since it must be played by more than one or two people and must be played outdoors.

Numerous baseball type games have been developed over the years to fill the gaps in participation in the actual game. Most of these, however, simply simulate baseball on a game board or electronically. They do not normally require any skills which are necessary to play the actual game.

Baseball practicing devices may also have been developed. One such device is shown, for example, in Pat. No. 4,258,916. This patented device is designed solely for batting practice. However, it does not provide very much practice since the ball is normally maintained in a stable, fixed position and is not pitched. Pitching machines, of course, have been utilized. However, these must be used outdoors.

SUMMARY OF THE INVENTION

There has been a need for a baseball type game which not only helps develop a player's skills such as in batting but which may be utilized indoors and include the excitement and challenge of a competitive game. This is accomplished by the present invention which is directed toward a baseball game including a horizontal platform with a simulated baseball field on the top surface thereof. A baseball is carried at the top end of a rod, the bottom end of which is spring mounted to the board adjacent home plate. The ball and rod are held downwardly against the spring force and in line with the pitcher's mound by an electromagnet and are pitched when a pitcher releases a switch for the electromagnet. The pitcher may also control whether the pitch will be directly across the plate, inside or outside. The batter hits the pitched ball forcing the ball and rod downwardly and the angular position at which it hits the platform will be sensed by one of a plurality of switches. A visual indicator connected to the switches will indicate the position at which the ball struck. The various positions will be assigned various results such as "out," "base hit," "home run," etc. which will also be indicated.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

FIG. 6 is a cross-sectional view taken through the line 6—6 of FIG. 2, and

FIG. 7 is a schematic diagram of the electrical circuit of the invention.

DETAILED DESCRIPTION OF THE PREFERRED EMBODIMENT

Figure 1:
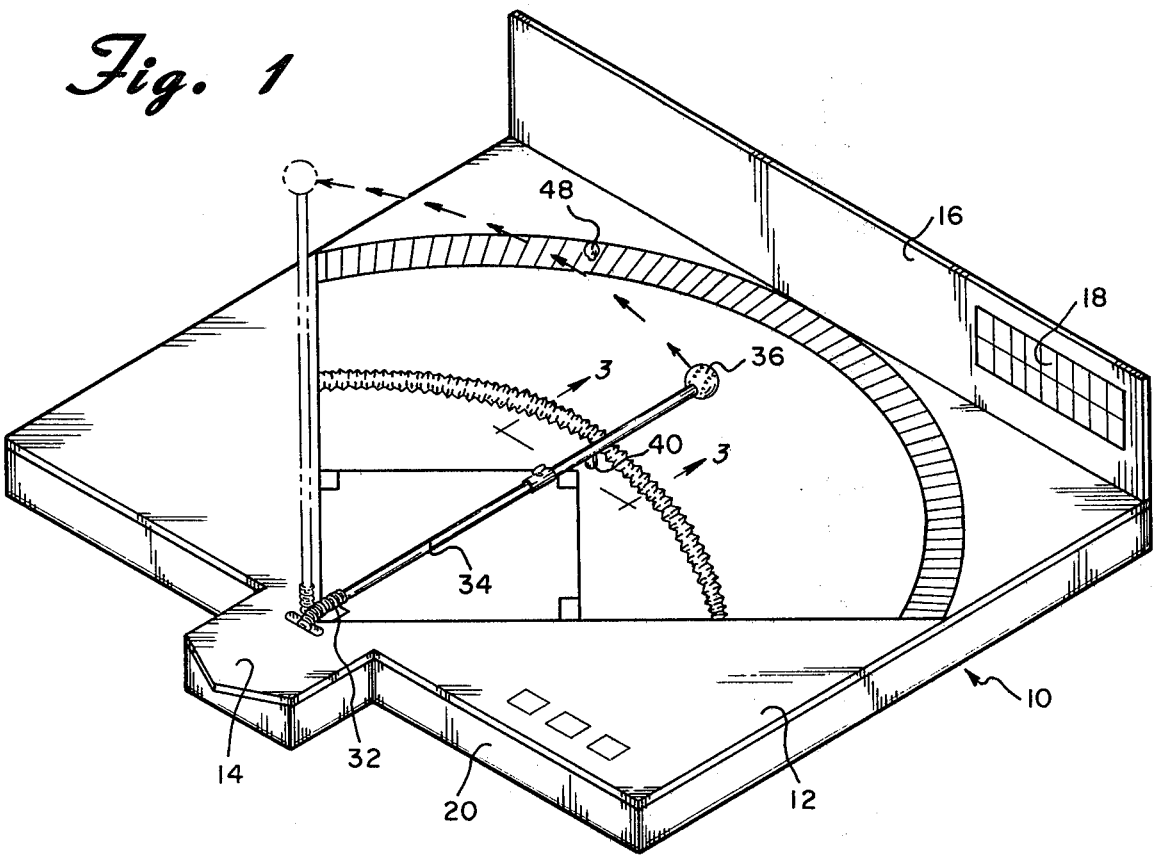
FIG. 1 is a perspective view of a baseball game constructed in accordance with the principles of the present invention and showing the ball being held downwardly prior to being pitched.
Figure 2:
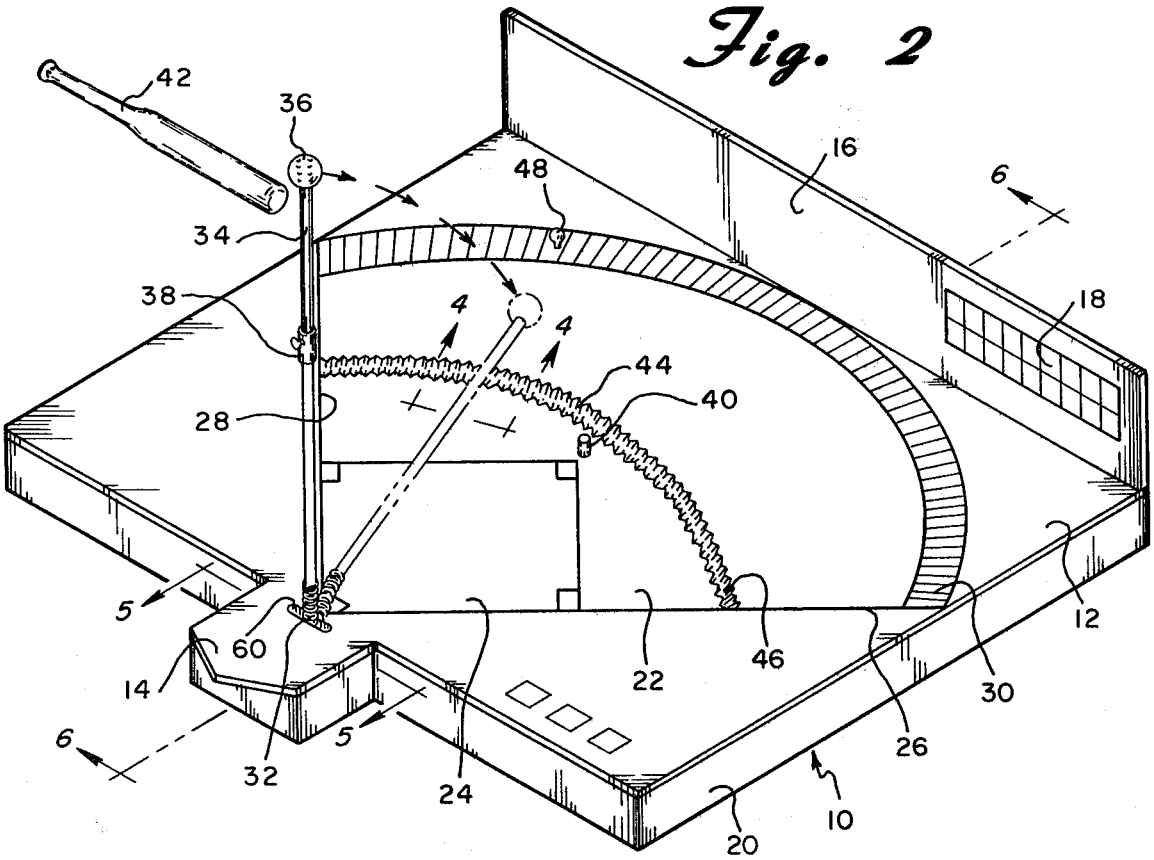
FIG. 2 is a view similar to FIG. 1 but showing the ball in an upright position after it has been pitched.

Referring now to the drawings in detail wherein like reference numerals have been used throughout the various figures to designate like elements, there is shown in FIGS. 1 and 2 a baseball game constructed in accordance with the principles of the present invention and designated generally as 10. FIG. 1 shows the game with the ball in a down position prior to being pitched and FIG. 2 shows the game with the ball in an upright position after it has been pitched.

The baseball game 10 is constructed on a substantially rectangularly shaped and horizontally disposed platform 12 which is preferably constructed from plywood or similar material. In the preferred embodiment, the size of the platform 12 is approximately five feet wide by four feet deep. However, this is by way of example only as other sizes are also possible. The platform 12 extends forwardly as shown at 14 to simulate a home plate. Extending upwardly from the rear edge of the platform 12 is an upright 16 which may also carry a scoreboard 18. The entire platform 12 is raised off the ground by a peripheral riser 20 which extends around the entire outer edge.

A simulated baseball field 22 is formed on the upper surface of the platform 12. As shown in FIGS. 1 and 2, the field is comprised of a baseball diamond 24, right and left foul lines 26 and 28 and an outfield with an area 30 which resembles a warning track. The warning track 30, however, is actually comprised of a plurality of lights and has a more specific function which will be described in detail below.

A coil spring 32 extends upwardly from the platform 12 adjacent the home plate 14. Fitted into the upper end of spring 32 is the lower end of an elongated rod 34. The upper end of the rod 34 carries a baseball 36 which is securely fastened thereto. Intermediate the ends of the rod 34 is a coupling device 38 which may be used to adjust the length or height of the rod 34.

Spring 32 is sufficiently strong enough to normally maintain the rod 34 and ball 36 in its normally upright or vertical position as shown in solid lines in FIG. 2 and in phantom in FIG. 1. However, with a moderate force applied, the rod 34 and ball 36 can be moved downwardly into a substantially horizontal position in a plane parallel to the platform 12. The rod 34 is capable of lying in any one of a number of horizontal positions on the platform. Two such positions are shown, for example, in FIGS. 1 (in solid line) and 2 (in phantom).

Located centrally of the platform 12 and just past second base in the diamond 24 is an electromagnet 40. As shown in FIG. 1, the electromagnetic 40 is capable of holding the rod 34 downwardly in a horizontal position against the force of spring 32. When the electromagnet 34 is de-energized by a remotely located switch SW1 (see FIG. 7), spring 32 forces the rod 34 and hence the ball 36 upwardly toward the upright position shown in phantom in FIG. 1. Preferably, the switch SW1 is a foot pedal which may be operated either by the batter who is about to hit the ball or by an opposing player standing nearby.

After the ball 36 is released and as it rises towards the upright position, a batter standing adjacent home plate and utilizing a bat 42 attempts to bat the ball. When the ball is struck, it and the rod 34 are forced downwardly against the weight of the spring 32. As shown in FIG. 2, the ball may be forced downwardly into any one of a number of angularly offset horizontal positions. When the ball 36 strikes the platform 12, the rod 34 temporarily rests in one of the plurality of valleys 44 located in comb 46 which is arcuately arranged on the platform 12 beyond the diamond 24.

Figure 3:
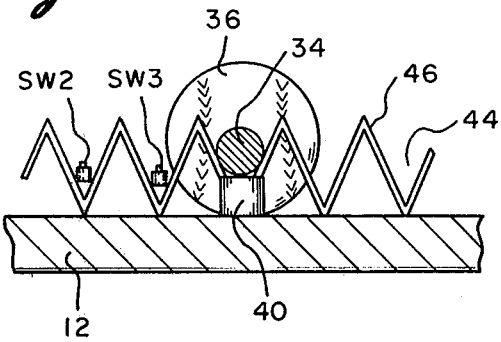
FIG. 3 is a cross-sectional view taken through the line 3—3 of FIG. 1.
Figure 4:
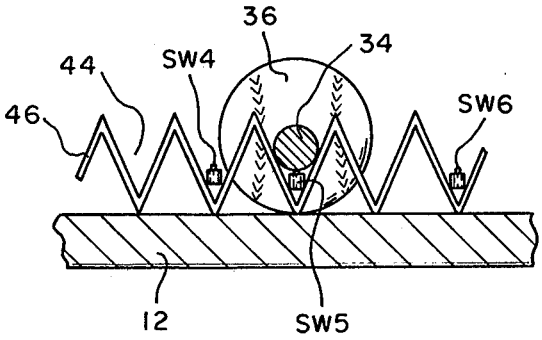
FIG. 4 is a cross-sectional view taken through the line 4—4 of FIG. 2.

The baseball game 10 also includes means for visually indicating the position at which the ball 36 strikes the platform 12. To this end, each of the valleys 44 in comb 46 is provided with switches SW2, SW3, SW4, etc. as shown in FIGS. 3 and 4. While only several of these switches are shown, this is by way of illustration only. It will be understood that a different switch will be located in each of the valleys 44.

As can be seen from FIG. 4, as the rod 34 enters the valley 44, it also strikes the actuator of the switch SW5. Preferably the switches are of the momentary contact type. Through an electrical circuit which will be described in detail hereinafter, closing of the contact of switch SW5 will cause one of a plurality of light bulbs 48 on platform 12 to be lighted. For clarity, only one such light bulb 48 is shown in FIGS. 1 and 2. It should be understood, however, that a separate light bulb is provided in each of the spaces in the warning track 30 and that there are the same number of such spaces and light bulbs as there are valleys 44 in the comb 46. Thus, each light bulb 48 has an associated valley 44 which is in direct angular alignment therewith. Thus, wherever the ball 36 strikes, the rod will actuate the associated switch in the valley 44 and the corresponding light bulb 48 will be lighted. Next to each light bulb will also be some indicia indicating the result of the hit such as base hit, out, home run, etc.

Prior to pitching the ball 36, a player can determine whether the ball should be pitched straight over the plate 14 or whether the pitch should be "inside" or "outside." This is accomplished by turning knob 50 located at the rear of the game beneath upright 16. The mechanism which allows for this is shown most clearly in FIGS. 5 and 6.

Figure 5:
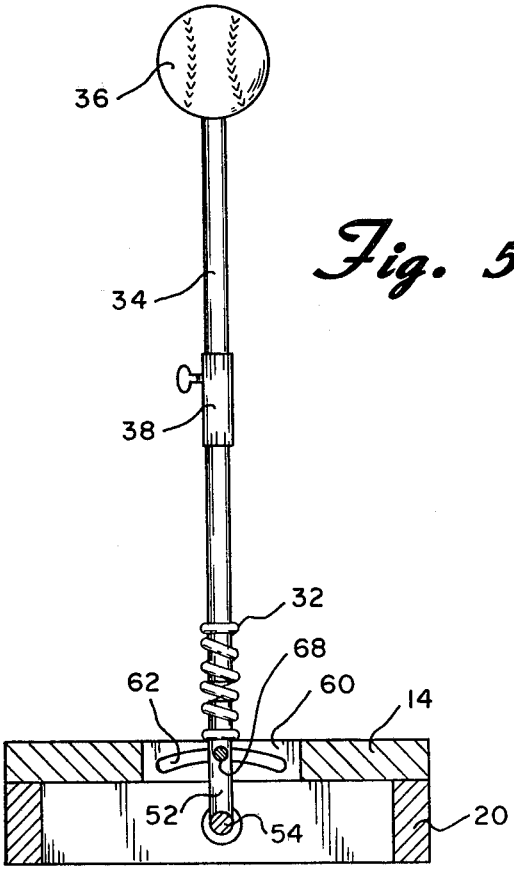
FIG. 5 is a cross-sectional view taken through the line 5—5 of FIG. 2.

Viewing FIGS. 5 and 6, it can be seen that the lower end of spring 32 is force fit over the top end of post 52. The lower end of post 52 is secured at right angles to horizontally dispose axle 54. The forward end of axle 54 freely turns in journal 56 while the rearward end passes through an opening in the rear riser 20 and terminates in the handle 50. A friction bearing 58 is formed in the riser 20 around the axle 54 so as to hold the axle 54 in the angular or turning position selected when knob 50 is turned.

Axle 54 is preferably made in two parts. The two parts are coupled together by way of an elastic coupling member 60. The elastic coupling member 60 will effectively store the turning force selected by turning the knob 50 and will transmit this turning force to the forward end of the axle 54 and hence to the post 52 at a later time (after the rod 34 is released from the electromagnet 40).

Since post 52 is attached to axle 54 in a perpendicular direction, rotary movement of axle 54 translates into arcuate movement of the rod 52. To allow for such arcuate movement, an elongated slot 60 is formed in the platform 12 adjacent the forward portion of home plate 14. The front and rear air surface of the slot 60 are undercut to form arcuately shaped grooves 62 and 64. The post 52 is provided with pins 66 and 68 which fit within the grooves 62 and 64 to held guide the post 52.

The foregoing described pitching device functions in the following manner. With the rod 34 downward in the pitching position and held by electromagnet 40, a player turns knob 50 in either desired direction. This turning force will be transmitted to the resilient coupling means 60. However, because the rod 34 is in a downward position, post 52 will not freely move thereby restraining movement of the front axle portion. As the ball is released by the electromagnet 40 and as it moves towards its upward position, post 52 can move more easily and the force being stored by the coupling means 60 rotates the front axle portion and hence the post 52. The upper end of post 52 will, therefore, be moved to either the right or the left as the ball is pitched. Consequently, the ball 36 at the top of rod 34 will also move either to the right or to the left.

The electrical circuit for operating the baseball game 10 is shown in FIG. 7. Preferably, a 6 or 12 volt source is utilized which may be provided by a step down transformer from a 120 volt source in a well known manner. The electromagnet 40 has one end connected to ground and the other end connected to one side of switch SW1. The other end of switch SW1 is connected to the 12 volt source. Switch SW1 is preferably of a normally closed type so that electromagnet 40 is always energized when the game is turned on. The electromagnet 40 is de-energized whenever switch SW1 is depressed thereby opening the same. As stated above, switch SW1 is preferably remotely located and in the form of a foot-operated switch so that the batter or a second opposing player can deactivate the electromagnet 40 at will.

One side of each of the switches SW2, SW3, etc. is also connected to the 12 volt source. Similarly, one side of each of the bulbs 48 are joined together and connected to ground. In between each of the switches SW2, SW3, etc. and each of the bulbs 48 is a relay R2, R3, etc., one relay being associated with each of the switches and bulbs. When a switch is depressed by the rod 34, the associated relay is actuated and held down thereby providing voltage to the associated bulb 48 thereby lighting the same. The relay will remain in the holding position so as to maintain the bulb lighted until power is removed from the relays through the use of normally closed reset switch SW9.

It should be pointed out that the electrical circuit shown in FIG. 7 is by way of example only. Many other circuits could also be utilized which would accomplish the same results. More particularly, electronic switches could be utilized in place of the relays and light emitting diodes or similar indicating devices could be utilized in place of the bulbs 48. Furthermore, switches SW2, SW3, etc. could be other types of mechanical switches or could be capacitance switches, light sensitive switches or various other devices.

The present invention may be embodied in other specific forms without departing from the spirit or essential attributes thereof and accordingly, reference should be made to the appended claims rather than to the foregoing specification as indicating the scope of the invention.

I claim:

1. A baseball game comprising:

a substantially horizontally disposed platform having a simulated baseball field on the upper surface thereof with home plate adjacent one side edge of the platform;

an elongated rod having a ball at the upper end thereof, the lower end of said rod being spring mounted to said platform adjacent home plate so that it can be moved between its normally upright position and a plurality of horizontal positions;

means for temporarily holding said rod in one of said horizontal positions;

means remotely located from said holding means for deactivating said holding means to thereby allow said rod to swing to its upright position under the force of said spring;

a baseball bat for batting said ball thereby moving said ball and said rod to one of said plurality of horizontal positions;

a plurality of sensing means, a different one of said sensing means being located at each of said plurality of positions, and indicating means for visually indicating the position to which said ball and rod have been batted.

2. The invention as set forth in claim 1 wherein said holding means is an electromagnet and wherein said deactivating means includes an electrical switch.

3. The invention as set forth in claim 1 wherein said sensing means includes a plurality of switching means and wherein said indicating means includes electrical lighting means.

4. The invention as set forth in claim 1 further including means for moving said ball and said rod to one side or the other as said rod is moving toward said upright position after being released by said holding means.

5. The invention as set forth in claim 4 wherein said means for moving is controlled by control means located remote from home plate, said control means being capable of controlling the amount and direction of movement of said rod.

* * * * *